US010894683B2

(12) United States Patent
Rasmussen et al.

(10) Patent No.: US 10,894,683 B2
(45) Date of Patent: Jan. 19, 2021

(54) SEQUENTIAL CLAMPING

(71) Applicant: Hewlett-Packard Development Company, L.P., Spring, TX (US)

(72) Inventors: Steve O Rasmussen, Vancouver, WA (US); Bruce G Johnson, Vancouver, WA (US); Elliott Downing, Vancouver, WA (US); Robert Scott Beale, Vancouver, WA (US); Lonny Morgan, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/331,585

(22) PCT Filed: Sep. 9, 2016

(86) PCT No.: PCT/US2016/051162
§ 371 (c)(1),
(2) Date: Mar. 8, 2019

(87) PCT Pub. No.: WO2018/048430
PCT Pub. Date: Mar. 15, 2018

(65) Prior Publication Data

US 2019/0210829 A1 Jul. 11, 2019

(51) Int. Cl.
*B65H 31/26* (2006.01)
*B65H 31/20* (2006.01)
(Continued)

(52) U.S. Cl.
CPC ..... *B65H 29/10* (2013.01); *B65H 31/20* (2013.01); *B65H 31/26* (2013.01); *B65H 43/00* (2013.01);
(Continued)

(58) Field of Classification Search
CPC . B65H 31/26; B65H 31/20; B65H 2301/4223
(Continued)

(56) References Cited

U.S. PATENT DOCUMENTS 3,951,264 A * 4/1976 Heidecker ..... G11B 17/049 206/308.3
6,311,971 B1 11/2001 Greer et al.
(Continued)

FOREIGN PATENT DOCUMENTS

CN 1590262 3/2005
CN 101169615 4/2008
(Continued)

OTHER PUBLICATIONS

Xerox ~ "Manage Paper Curl" ~ http://www.support.xerox.com/ ~ 2016 ~ 2 pages.

*Primary Examiner* — Luis A Gonzalez
(74) *Attorney, Agent, or Firm* — HP Inc. Patent Department

(57) ABSTRACT

An example system includes an advancement mechanism to drive print medium into a stacking region, a clamping mechanism, and a controller. The clamping mechanism includes a trailing edge clamping arrangement in a trailing edge portion of the stacking region and at least one downstream clamping arrangement in a downstream portion of the stacking region, the downstream portion being downstream of the trailing edge portion. The controller is to sequentially actuate the trailing edge clamping arrangement and the at least one downstream clamping arrangement when the advancement mechanism transports a print medium into the stacking region.

12 Claims, 7 Drawing Sheets

(51) Int. Cl.
*B65H 29/10* (2006.01)
*B65H 43/00* (2006.01)

(52) U.S. Cl.
CPC ..... *B65H 2301/134* (2013.01); *B65H 2301/4212* (2013.01); *B65H 2301/4223* (2013.01); *B65H 2601/211* (2013.01); *B65H 2801/06* (2013.01)

(58) Field of Classification Search
USPC ..... 271/220
See application file for complete search history.

(56) References Cited

U.S. PATENT DOCUMENTS

| | | | |
|---|---|---|---|
| 6,819,906 | B1 | 11/2004 | Herrmann et al. |
| 8,123,209 | B2 | 2/2012 | Kubota et al. |
| 2008/0054551 | A1 | 3/2008 | Obuchi |
| 2012/0267845 | A1 | 10/2012 | Rutten et al. |

FOREIGN PATENT DOCUMENTS

| | | | |
|---|---|---|---|
| CN | 103171923 | | 6/2013 |
| CN | 104291148 | | 1/2015 |
| CN | 204223916 | | 3/2015 |
| JP | S6270165 | A | 3/1987 |
| JP | 2004284773 | A | 10/2004 |
| JP | 2006124051 | | 5/2006 |
| JP | 2007302357 | | 11/2007 |
| JP | 2011093632 | | 5/2011 |
| JP | 5125064 | B2 | 1/2013 |
| JP | 2013060241 | | 4/2013 |
| JP | 5278805 | B2 | 9/2013 |
| WO | WO-2004069709 | | 8/2004 |

* cited by examiner

SEQUENTIAL CLAMPING

BACKGROUND

Imaging systems, such as printers, generally include a stacking region for the collection of print media. The stacking region may be an output region where a user may receive the print media. In some examples, imaging systems may be provided with a finishing mechanism where the print media may be collected for post processing, such as stapling, three-hole punching, etc. In this regard, the stacking region may be within the imaging system where the print media are collected for post processing.

BRIEF DESCRIPTION OF THE DRAWINGS

For a more complete understanding of various examples, reference is now made to the following description taken in connection with the accompanying drawings in which.

DETAILED DESCRIPTION

Various examples provide for clamping of print media, such as a sheet, as it is delivered onto a stacking region which may collect a stack of sheets. The clamping system reduces or eliminates offset between the various sheets in the output stack to facilitate various post-processing functions, such as stapling. The clamping system further reduces or eliminates curling of the edges of the sheets in the stack, as well as reducing air which may be trapped between the sheets. In various examples, a system may be provided with trailing edge clamp to clamp a trailing edge of an incoming sheet to the stack and additional clamps in the downstream portion of the stacking region. In one example, the additional clamps leading edge clamps at the leading edge portion of the stacking region and a middle clamp in the middle portion. The clamps are actuated sequentially as a new sheet is delivered into the stacking region.

As described above, in some examples, print media may be collected for post processing, such as stapling, three-hole punching. In some cases, such as in inkjet printers where the ink may not be fully dried during stacking, alignment of sheets in a stack may become difficult. For example, the inkjet output sheets may be distorted from curl forming on the edges. Further, due to the moisture content, the sheets may have reduced stiffness which adds to the curl, and high ink density regions may result in increased friction with adjacent sheets. The friction can result in misalignment with other sheets in the stack. Additionally, curling of reduced stiffness in the sheets can result in trapped air between the sheets. The trapped air can result in a variety of issues, such as an artificial increase in stack height.

Accordingly, the present disclosure describes example systems and methods to facilitate alignment of sheets in a stack. Various examples described herein provide clamping of sheets in a stacking region to facilitate the alignment.

Figure 1:
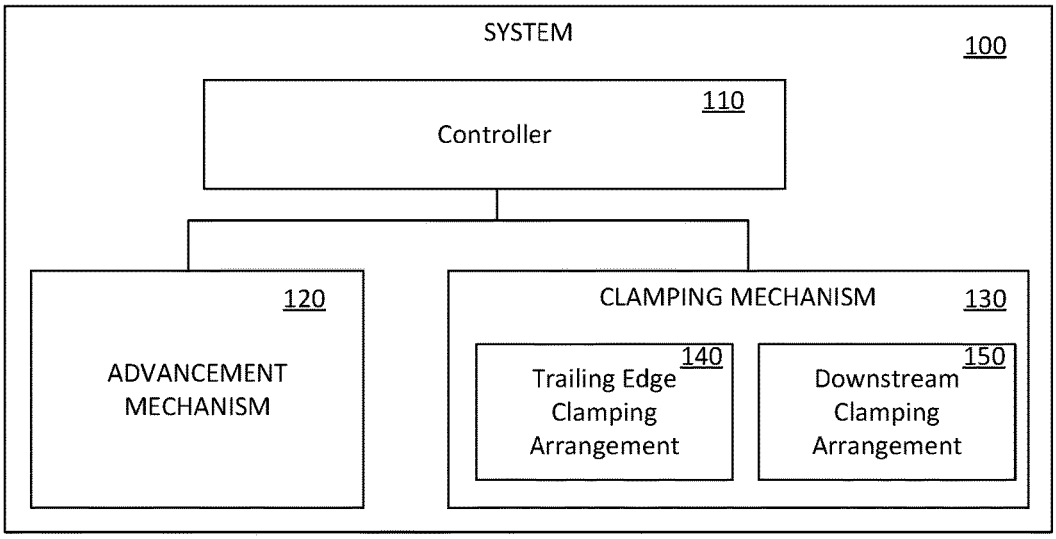
FIG. 1 is a schematic illustration of an example system for sequential media clamping.

Referring now to the figures, FIG. 1 illustrates an example system for sequential media clamping is schematically illustrated. The example system 100 may be implemented in a variety of imaging devices, such as printers or copiers, for example. In some examples, the example system 100 of FIG. 1 is implemented in a finishing portion of an imaging device. The example system 100 includes a controller 110 to control operation various aspects of the example system 100. In some examples, the controller 110 may be a part of a processor of a larger system, such as an imaging system which contains the example system 100 as a finishing portion. The controller 110 of the example system 100 may be implemented as hardware, software, or firmware, for example.

The example system 100 further includes an advancement mechanism 120 to transport print media into a stacking region. In various examples, the advancement mechanism 120 may include rollers and/or puller clamps which translate to move the print media from an output of an imaging portion, for example, into the stacking region. The controller 110 may be provided with an indication of an incoming print medium and may, in response, position the advancement mechanism 120 to transport the incoming print medium into the stacking region.

The example system 100 of FIG. 1 further includes a clamping mechanism 130. The clamping mechanism 130 of the example system 100 is provided to facilitate alignment of the incoming print medium with other media that may be in the stacking region. In this regard, the clamping mechanism 130 is provided with various features which function to reduce, minimize or eliminate the issues describe above, such as curling and trapping of air.

The clamping mechanism 130 of the example system 100 is provided with a trailing edge clamping arrangement 140 positioned in a trailing edge portion of the stacking region. In this regard, the trailing edge portion of the stacking region is the area in which the trailing edge of the print media rests when the print media are fully transported into the stacking region. Of course, the trailing edge of the print media refers to the portion of a print medium which trails the remainder of that print medium in the direction of transport.

In addition to the trailing edge clamping arrangement 140, the clamping mechanism 130 of the example system 100 is provided with at least one downstream clamping arrangement 150 in a downstream portion of the stacking region. The downstream portion of the stacking region is downstream of the trailing edge portion in the direction of the transport of the print media.

In various examples of the example system 100, the controller 110 sequentially actuates the trailing edge clamping arrangement 140 and the at least one downstream clamping arrangement 150 when the advancement mechanism 120 transports a print medium into the stacking region. In one example, the sequential actuation includes first actuating the trailing edge clamping arrangement 140 and then clamping additional clamping arrangements.

For example, as the print medium is transported into the stacking region, the controller 110 actuates the trailing edge clamping arrangement 140 to secure the trailing edge of the print medium. In various examples, the actuating of the trailing edge clamping arrangement 140 occurs before the controller 110 causes the print medium to be released by the advancement mechanism.

Thus, in one example, the sequential actuation of the trailing edge clamping arrangement 140 and the downstream clamping arrangement 150 by the controller 110 includes activating the advancement mechanism 120 to drive the print medium into the stacking region. When the print medium reaches a predetermined point in the stacking region, the controller 110 actuates the trailing edge clamping arrangement 140 to secure the trailing edge of the print medium at the trailing edge portion of the stacking region. The controller 110 then causes releasing of the advancement mechanism 120 with the trailing edge clamping arrangement 140 actuated. Thus, the advancement mechanism 120 releases the print medium while the trailing edge of the print medium is secured in place by the trailing edge clamping arrangement 140. The controller 110 may then actuate the at least one downstream clamping arrangement 150 to secure downstream portion of the print medium.

Figure 2:
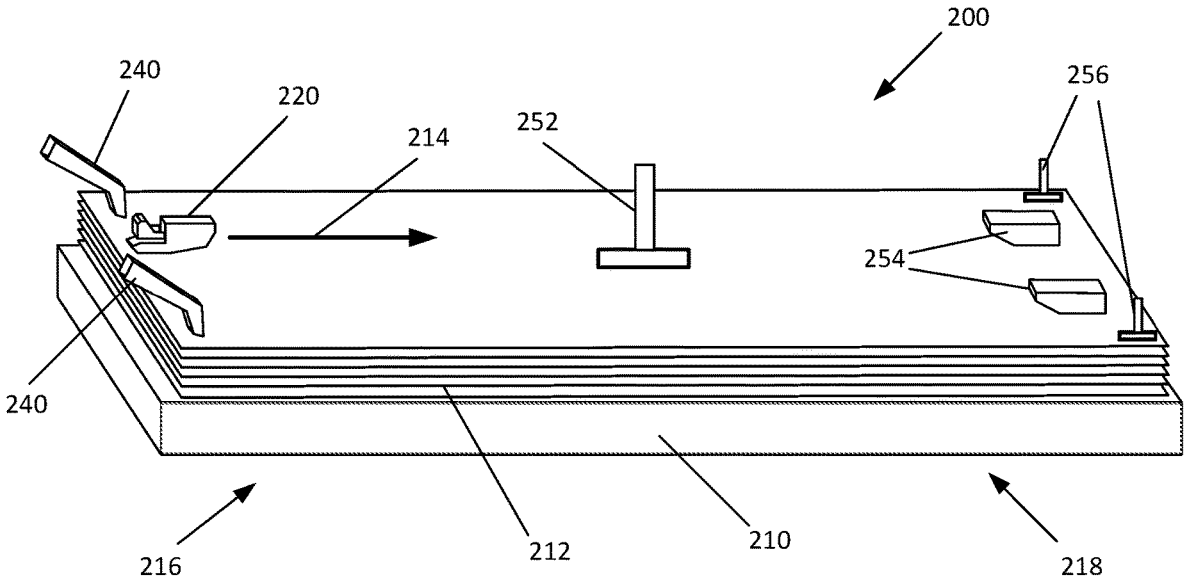
FIG. 2 is a perspective illustration of an example sequential clamping system.

Referring now to FIG. 2, an example clamping system 200 is illustrated in a perspective view. The example clamping system 200 of FIG. 2 includes a platform 210 for accommodating a stack 212 of print media, such as sheets of paper. In this regard, the platform 210 forms a stacking region for the print media. In the example of FIG. 2, the print media are transported onto the platform 210 in the direction indicated by the arrow 214. Accordingly, the stacking region formed by the platform 210 includes a trailing edge portion 216 on which the trailing edge of the transported media rests when stacked. Similarly, the platform 210 includes a downstream portion 218 which is downstream of the trailing edge portion 216.

The example clamping system 200 of FIG. 2 includes an advancement mechanism 220. The advancement mechanism 220 of the example clamping system 200 may be a puller clamp which may engage a leading edge of a print medium (not shown) as the print medium is delivered into the stacking region of the platform 210 from, for example, an image forming portion (not shown). The puller clamp may then translate in the direction of the arrow 214, thus transporting the print medium onto the platform 210 or the stack 212. Of course, various examples of the advancement mechanism 220 (e.g., the puller clamp) may include various components not shown, such as gearing mechanism, to facilitate operation of the advancement mechanism 220. Further, as described above with reference to claim 1, operation of the advancement mechanism 220 may be controlled by a controller (not shown in FIG. 2).

The example clamping system 200 of FIG. 2 includes various clamps to secure an incoming print medium and/or the stack 212 to, for example, reduce or eliminate curling or trapped air between sheets of the stack 212. In this regard, the example clamping system 200 of FIG. 2 includes trailing edge clamps 240 and various downstream clamps. In the example of FIG. 2, the example clamping system 200 is provided with two trailing edge clamps 240 positioned along the width of the trailing edge portion 216 of the platform 210 or the stacking region. As noted above, the trailing edge clamps 240 may be controlled by a controller (not shown in FIG. 2).

In the example clamping system 200 of FIG. 2, the downstream clamps include a middle clamp 252 and a leading edge clamping arrangement which includes two leading edge clamps 254. The middle clamp 252 is positioned in a central region of the platform 210, for example, substantially at a center of the stacking region. While the example of FIG. 2 is provided with a single middle clamp 252, other examples may include two or more middle clamps spread out in a central portion of the platform 210.

Further, in the example of FIG. 2, the two leading edge clamps 254 are positioned along the width of a leading edge portion of the platform 210. In addition, the downstream clamps of the example of FIG. 2 further include various corner clamps 256 to facilitate reduction or elimination of corner curl in the print media. The corner clamps 256 may be positioned on or near the ends of the width of the leading edge portion of the platform 210 or the stacking region.

Figure 3:
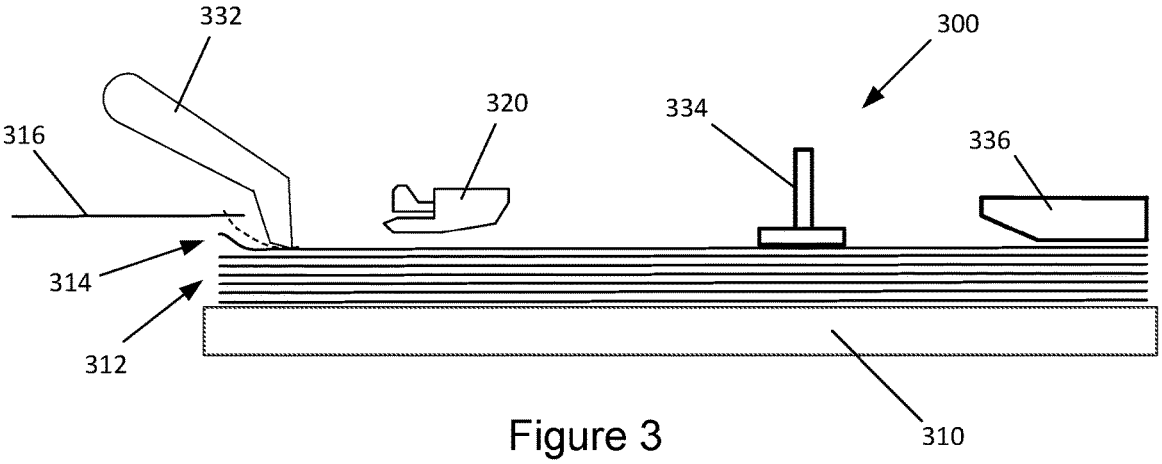
FIGS. 3-10 are side views of an example sequential clamping system illustrating an example process for sequential clamping.

Referring now to FIGS. 3-10, side views of an example clamping system are provided to illustrate an example process for sequential clamping. Referring first to FIG. 3, the example clamping system 300 is illustrated with a stack 312 of sheets of print media on a platform 310. The stack 312 is positioned on the platform 310 with an incoming sheet 316 which has not yet entered the stacking region. Thus, the incoming sheet 316 has not yet been engaged by an advancement mechanism (e.g., a puller clamp 320) provided to transport the incoming sheet 316 into the stacking region. In this position, the stack 312 is positioned with various clamps 332, 334, 336 actuated to be in contact with the topmost sheet in the stack. In particular, a trailing edge clamp 332, a middle clamp 334 and a leading edge clamp 336 are shown in FIG. 3 as securing the stack 312.

In the example of FIG. 3, a trailing edge of the topmost sheet of the stack 312 is secured by a trailing edge clamp 332 at a trailing edge portion of the stacking region formed by the platform 310. As described above with reference to FIG. 2, the example clamping system 300 of FIG. 3 may be provided with two or more trailing edge clamps 332 positioned along the width of the trailing edge portion of the stacking region. FIG. 3 illustrates an example effect of the use of the leading edge clamp 332 in reducing curling 314 of the topmost sheet of the stack 312. As illustrated by the dotted line in FIG. 3, without the use of the trailing edge clamp 332, the curling may interfere with the incoming sheet 316.

In addition to the trailing edge clamp 332 in the trailing edge portion of the stacking region, the example system 300 is further provided with the middle clamp 334 and the leading edge clamp 336 in a downstream portion of the stacking region. As noted above with reference to FIG. 2, the example system 300 may be provided with two or more leading edge clamps 336, as well as additional corner clamps not shown in FIG. 3.

Figure 4:
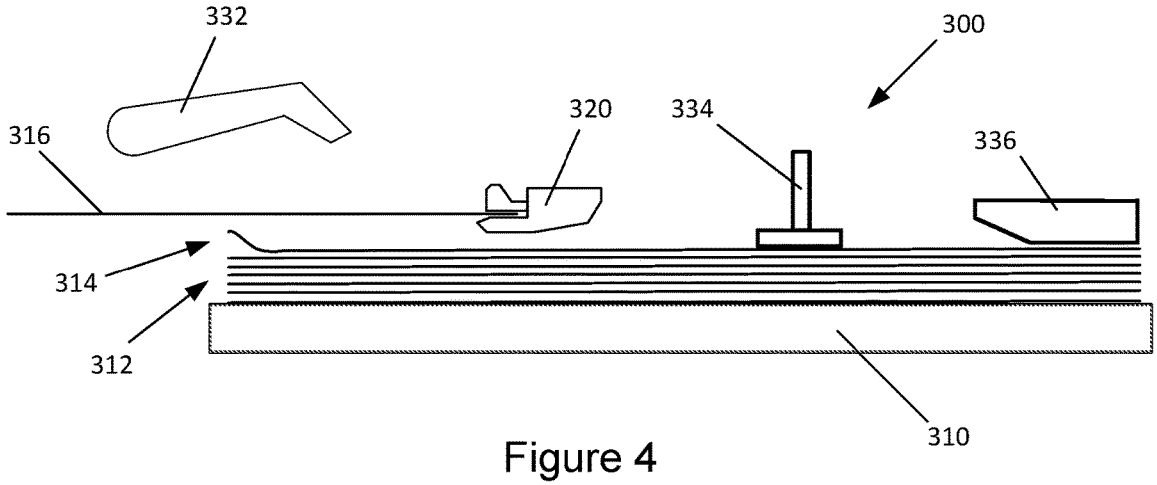
Figure 5:
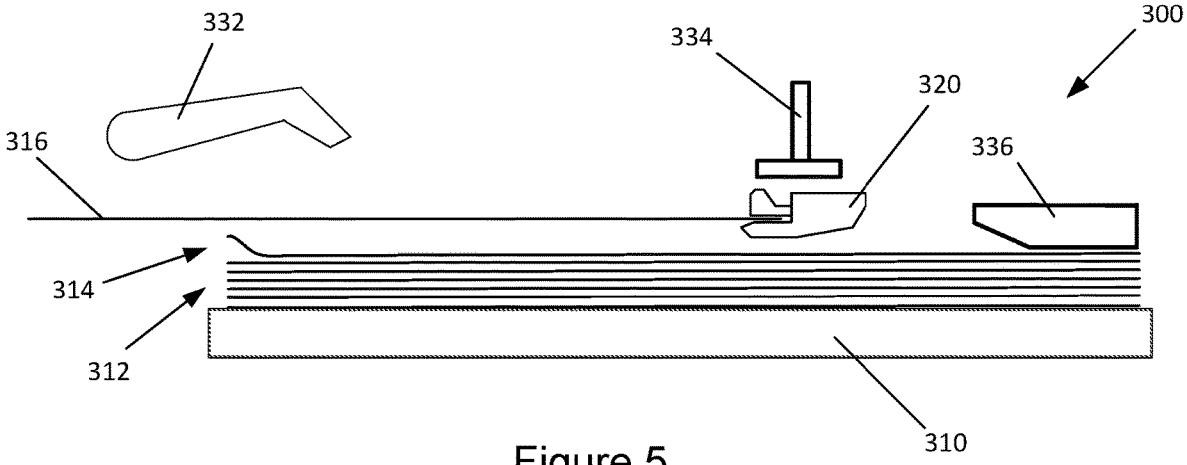
Figure 6:
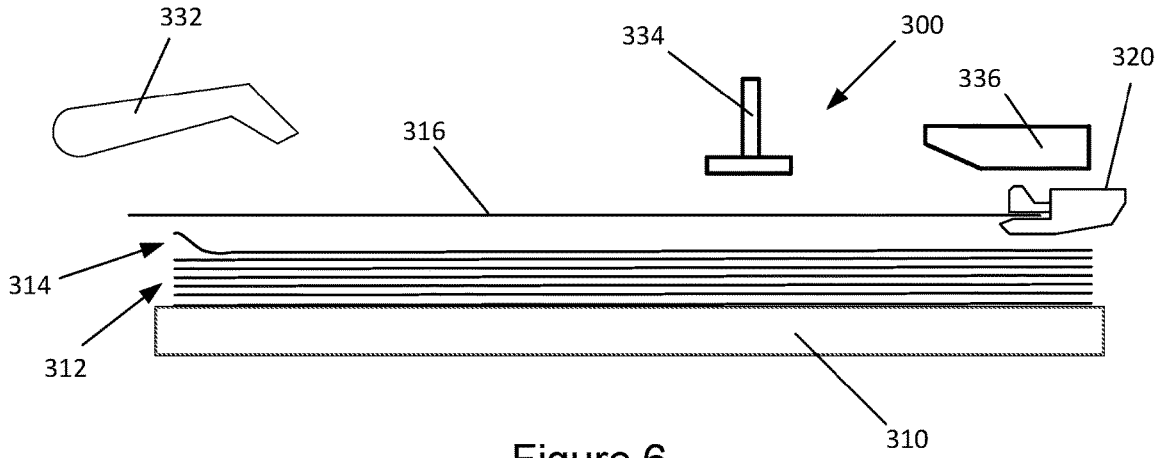

Referring now to FIG. 4, as the incoming sheet 316 is delivered to the stacking region from, for example, an image forming portion, it is engaged by the puller clamp 320. As described above, operation of the puller clamp 320 may be controlled by a controller (e.g., the controller 110 of FIG. 1). Further, sensors may be provided to indicate to the controller that the incoming sheet 312 is in a position to be engaged by the puller clamp 320. Once engaged by the puller clamp 320, the sheet is transported toward the stacking region formed by the platform 310 (to the right in FIG. 4). The trailing edge clamp 332 is raised just prior to the leading edge of the incoming sheet passing the position of the trailing edge clamp 332. Thus, as illustrated in FIG. 4, the trailing edge clamp 332 is in the raised position.

As the puller clamp 320 transports the incoming sheet 316 further into the stacking region, the middle clamp 334 (FIG. 5) and the leading edge clamp 336 (FIG. 6) are sequentially raised to permit passage of the incoming sheet 316. Of course, any additional clamps, such as corner clamps, would also be sequentially raised as needed to allow the incoming sheet 316 to be transported into the stacking region.

Figure 7:
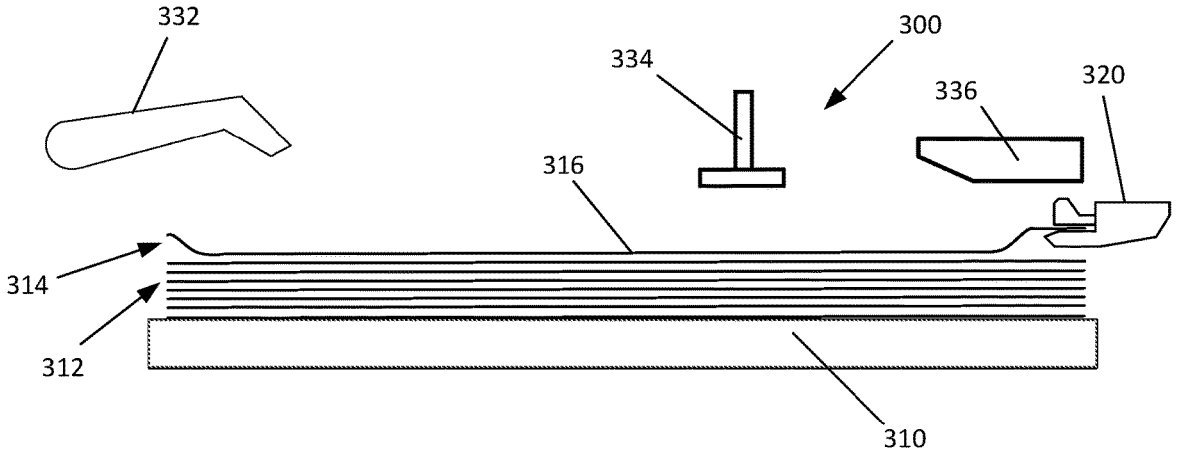

Referring now to FIG. 7, when the incoming sheet 316 is sufficiently within the stacking region, it may clear guides or channels that may be formed along the media path, causing the incoming sheet 316 to drop onto the stack 312. At this point, the incoming sheet 316 may remain engaged by the puller clamp 320.

Figure 8:
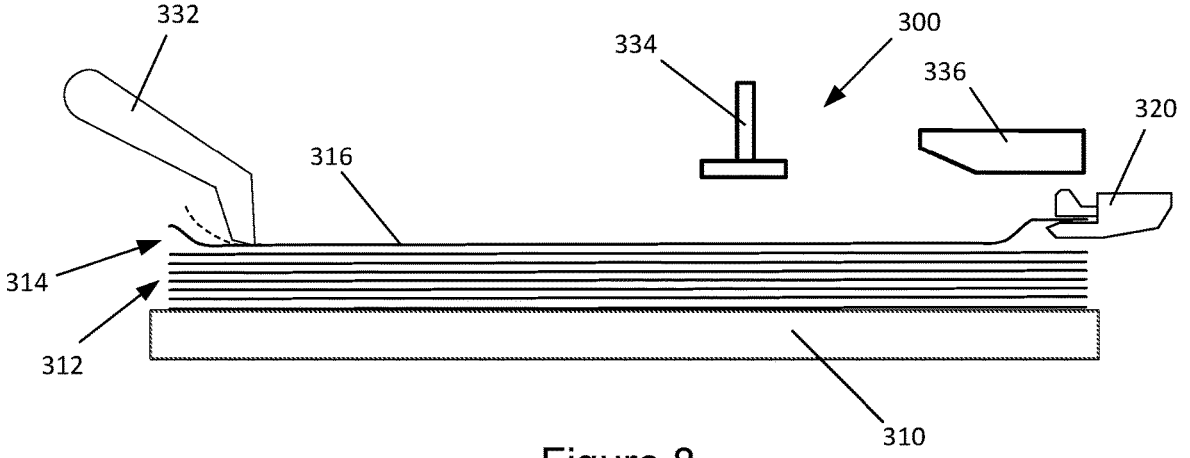

Once the incoming sheet 316 has reached a predetermined state, the trailing edge clamp 332 is actuated and brought into contact with the incoming sheet 316, as illustrated in FIG. 8. In this regard, the trailing edge clamp 332 may be actuated once the incoming sheet 316 is properly aligned, for example, against a surface on one edge of the incoming sheet 316. Thus, the trailing edge clamp 332 may serve to hold the incoming sheet 316 in place. In some examples, the trailing edge clamp 332 may function to secure the incoming sheet 316 against movement from a bounce back due to energy stored within the incoming sheet 316 due to buckling against a surface in the stacking region. Further, as noted above with reference to FIG. 3, the trailing edge clamp 332 serves to reduce curling that may exist in the trailing edge of the incoming sheet, as indicated by the dotted line in FIG. 3.

Figure 9:
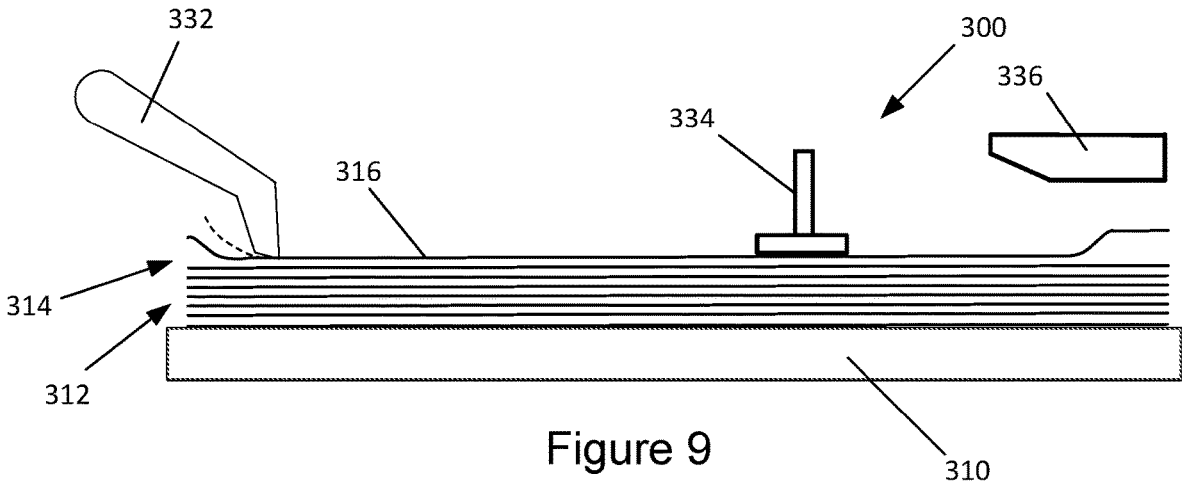

Referring now to FIG. 9, once the incoming sheet 316 is disengaged from the puller clamp 320 (not shown in FIG. 9 for clarity), the middle clamp 334 may be actuated and brought down into contact with the incoming sheet 316 and the stack 312. The actuation of the middle clamp 334 may reduce any bumps that may exist in the incoming sheet 316. Further, the middle clamp 334 may prevent air pockets from forming between the incoming sheet 316 and the existing stack 312.

Figure 10:
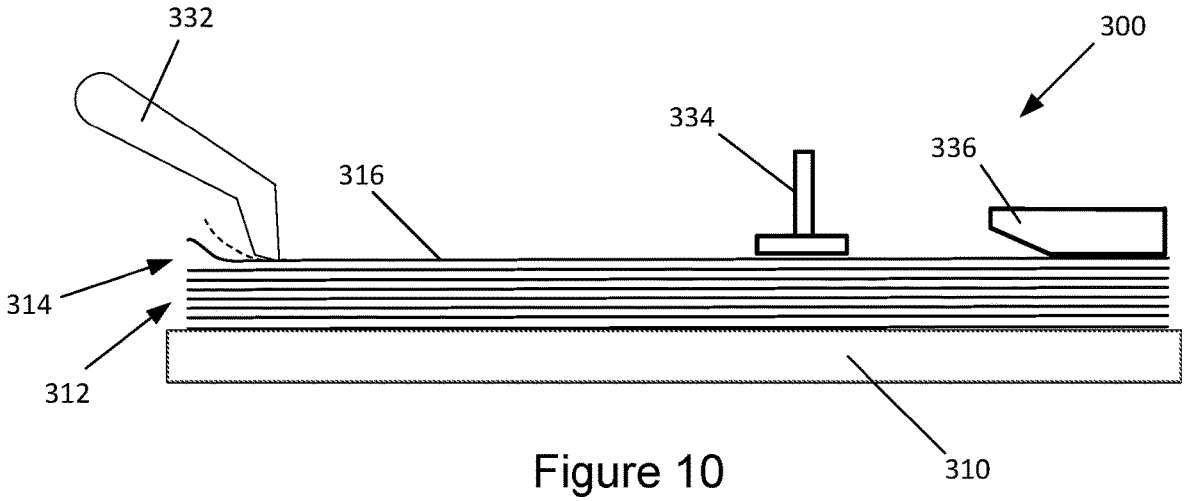

Referring now to FIG. 10, the leading edge clamp 336 is actuated and brought down in contact with the incoming sheet 316. The leading edge clamp 336 may serve to reduce or eliminate curling of the leading edge of the incoming sheet 316. Of course, as noted above, additional clamps, such as corner clamps may be deployed to further reduce or eliminate curling of the incoming sheet 316 and the stack. The system 300 may now be ready to receive another incoming sheet and repeat the process.

Figure 11:
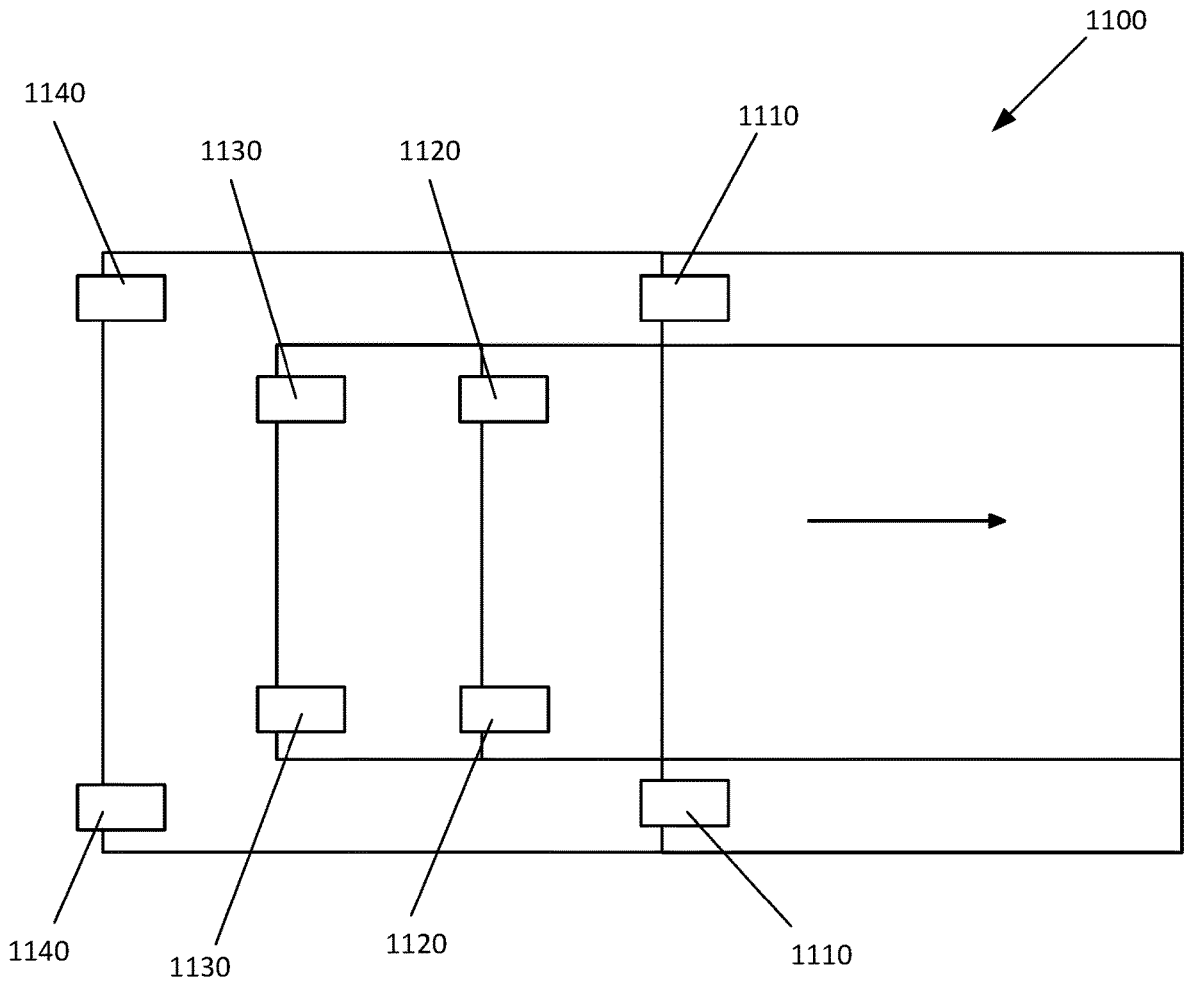
FIG. 11 is a top view of another example system for sequential media clamping.

Referring now to FIG. 11, a top view of another example system for sequential media clamping is illustrated. The example system 1100 of FIG. 11 with a variety of trailing edge clamps 1110, 1120, 1130, 1140 to accommodate different sizes of print media. For purposes of clarity, the example system 1100 is illustrated in FIG. 11 with all other clamps removed. Of course, it will be understood that the example system 1100 may include additional clamps such as middle clamps, leading edge clamps and corner clamps, as described above.

In the example system 1100 of FIG. 11, a controller may identify the size and orientation of an incoming print medium and may, accordingly, actuate an appropriate set of trailing edge clamps. For example, trailing edge clamps 1110 may be actuated for a letter-sized or an A4 print medium in a landscape orientation. Similarly, trailing edge clamps 1120 may be actuated for a letter-sized or an A4 print medium in a portrait orientation, trailing edge clamps 1130 may be actuated for a legal-sized print medium, and trailing edge clamps 1140 may be actuated for a ledger-sized or an A3 print medium. In one example, all other trailing edge clamps not corresponding to the size and orientation of the incoming medium may be retained in a retracted, or up, position.

Figure 12:
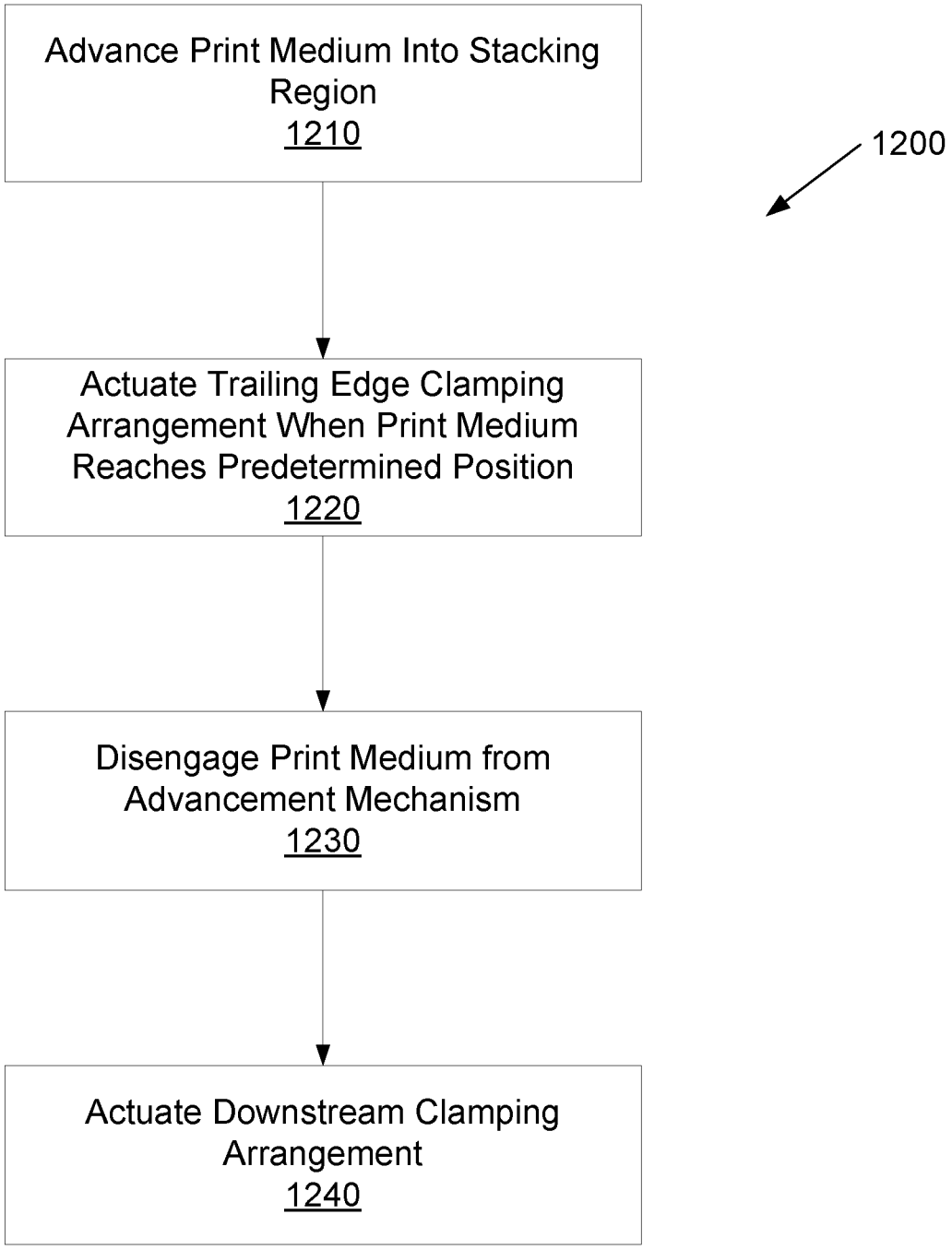
FIG. 12 is a flow chart illustrating an example process for media clamping.

Referring now to FIG. 12, a flow chart illustrates an example method for sequential clamping of print media. The example method 1200 of FIG. 12 may be implemented in a variety of manners, such as in the controller 110 of the example system 100 of FIG. 1.

The example method 1200 includes advancing of a print medium into a stacking region (block 1210). For example, as illustrated above with reference to FIGS. 3-10, an advancement mechanism, such as the puller clamp 320, may be activated when a print medium is detected for transport into the stacking region. The puller clamp 320 then advances the incoming sheet 316 into the stacking region formed by the platform 310.

When the print medium reaches a predetermined position, a trailing edge clamping arrangement is actuated (block 1220). In this regard, the trailing edge clamping arrangement may include trailing edge clamps, such as trailing edge clamps 332 positioned at the trailing edge of the stacking region. Actuation of the trailing edge clamping arrangement includes bringing the trailing edge clamps into contact with the incoming sheet. As described above with reference to FIG. 8, the trailing edge clamp 332 may be actuated once the incoming sheet 316 is properly aligned, for example, against a surface on one edge of the incoming sheet 316. Further, in various examples, the actuation of the trailing edge clamping arrangement occurs while the print medium is still engaged by the advancement mechanism, as illustrated in the example of FIG. 8.

The example method 1200 further includes disengaging the print medium from the advancement mechanism (block 1230). For example, as described above with reference to FIG. 9, once the print medium is secured by the trailing edge clamp 332, the print medium may be released by the puller clamp 320.

Finally, a downstream clamping arrangement may be actuated (block 1240). As described above, a downstream clamping arrangement may include a variety of clamps that are positioned in a downstream portion of the stacking region. For example, as described above with reference to FIG. 1, an example system may include middle clamp, leading edge clamps and corner clamps. Each of the clamps in the downstream clamping arrangement may be actuated and brought into contact with the print medium.

Figure 13:
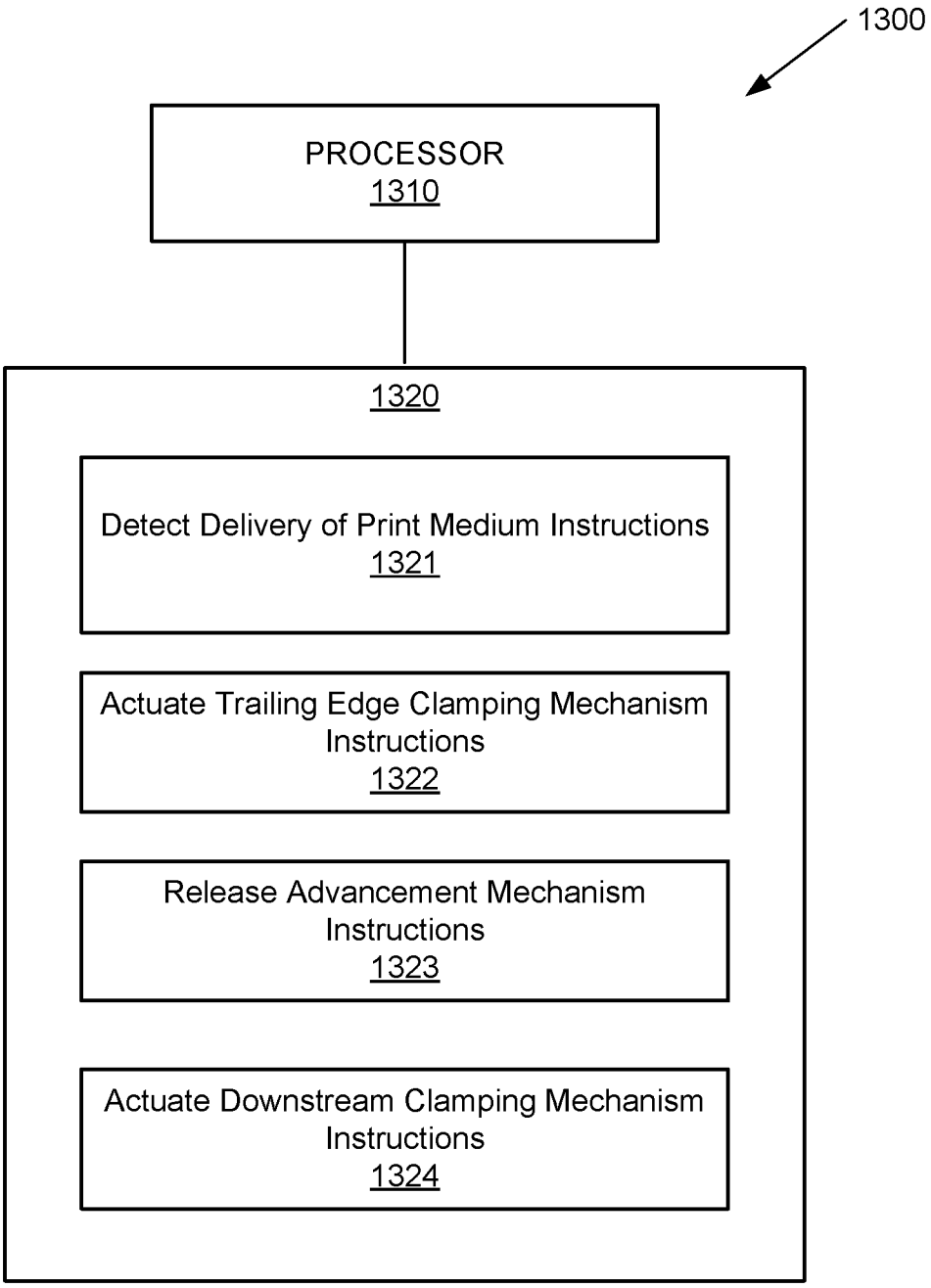
FIG. 13 illustrates a block diagram of an example system with a computer-readable storage medium including instructions executable by a processor for media clamping.

Referring now to FIG. 13, a block diagram of an example system is illustrated with a non-transitory computer-readable storage medium including instructions executable by a processor for sequential clamping of print media. The system 1300 includes a processor 1310 and a non-transitory computer-readable storage medium 1320. The computer-readable storage medium 1320 includes example instructions 1321-1324 executable by the processor 1310 to perform various functionalities described herein. In various examples, the non-transitory computer-readable storage medium 1320 may be any of a variety of storage devices including, but not limited to, a random access memory (RAM) a dynamic RAM (DRAM), static RAM (SRAM), flash memory, read-only memory (ROM), programmable ROM (PROM), electrically erasable PROM (EEPROM), or the like. In various examples, the processor 1310 may be a general purpose processor, special purpose logic, or the like.

The example instructions include detect delivery of print media instructions 1321. For example, as described above with reference to FIG. 4, sensors may be provided to indicate to a controller that an incoming sheet is in a position to be engaged by the puller clamp 320. In one example, the detect delivery of print media instructions 1321 may further include instructions to engage the print medium with an advancement mechanism, such as the puller clamp 320 and to advance the print medium into a stacking region.

The example instructions further include actuate trailing edge clamping mechanism instructions 1322. As described above, when the print medium reaches a predetermined position, a trailing edge clamping arrangement is actuated to bring trailing edge clamps into contact with the incoming sheet. In one example, the trailing edge clamping mechanism may be actuated once the incoming sheet is properly aligned, for example, against a surface on one edge of the incoming sheet.

The example instructions further include release advancement mechanism instructions 1323. For example, once the print medium is secured by the trailing edge clamping mechanism, the print medium may be released by the advancement mechanism (e.g., the puller clamp 320 of FIGS. 3-10).

The example instructions further include actuate downstream clamping mechanism instructions 1324. The downstream clamping mechanism may include, for example, a middle clamp, leading edge clamps and corner clamps. Each of the clamps in the downstream clamping mechanism may be actuated and brought into contact with the print medium.

Thus, in accordance with various examples described herein, sequential clamping of print media may be used to facilitate alignment of the media in a stack. The sequential clamping may include sequential actuation of trailing edge clamps and at least one downstream clamp. Examples of the sequential clamping described herein can reduce or eliminate curling of the print media, as well prevent formation of air pockets between sheets of the print media.

The foregoing description of various examples has been presented for purposes of illustration and description. The foregoing description is not intended to be exhaustive or limiting to the examples disclosed, and modifications and variations are possible in light of the above teachings or may be acquired from practice of various examples. The examples discussed herein were chosen and described in order to explain the principles and the nature of various examples of the present disclosure and its practical application to enable one skilled in the art to utilize the present disclosure in various examples and with various modifications as are suited to the particular use contemplated. The features of the examples described herein may be combined in all possible combinations of methods, apparatus, modules, systems, and computer program products.

It is also noted herein that while the above describes examples, these descriptions should not be viewed in a limiting sense. Rather, there are several variations and modifications which may be made without departing from the scope as defined in the appended claims.

What is claimed is:

1. A system, comprising:

an advancement mechanism to drive a print medium into a stacking region;

a clamping mechanism, comprising:

a trailing edge clamping arrangement in a trailing edge portion of the stacking region; and a downstream clamping arrangement in a downstream portion of the stacking region, the downstream clamping arrangement including a leading edge clamping arrangement in a leading edge portion of the stacking region and a middle clamping arrangement between the trailing edge portion and the leading edge portion; and a controller to sequentially actuate the trailing edge clamping arrangement and the downstream clamping arrangement when the advancement mechanism transports a print medium into the stacking region.

2. The system of claim 1, wherein the controller is to sequentially actuate the trailing edge clamping arrangement and the downstream clamping arrangement by:

activating the advancement mechanism to drive the print medium into the stacking region;

actuating the trailing edge clamping arrangement to secure a trailing edge of the print medium at the trailing edge portion of the stacking region;

releasing the advancement mechanism with the trailing edge clamping arrangement actuated; and actuating the downstream clamping arrangement to secure a downstream portion of the print medium in the stacking region.

3. The system of claim 1, wherein the trailing edge clamping arrangement includes at least two clamps spaced along a width of the trailing edge portion of the stacking region.

4. The system of claim 1, wherein the leading edge clamping arrangement includes at least two clamps spaced along a width of the leading edge portion of the stacking region.

5. The system of claim 4, wherein the leading edge clamping arrangement further includes corner clamps on ends of the width of the leading edge portion of the stacking region.

6. The system of claim 1, wherein the middle clamping arrangement includes a single clamp positioned substantially at a center of the stacking region.

7. A method, comprising:

advancing a print medium into a stacking region, the print medium being engaged by an advancement mechanism;

actuating a trailing edge clamping arrangement when the print medium reaches a predetermined position in the stacking region;

disengaging the print medium from the advancement mechanism; and actuating a downstream clamping arrangement in a downstream portion of the stacking region, the downstream clamping arrangement including a leading edge clamping arrangement in a leading edge portion of the stacking region and a middle clamping arrangement between the trailing edge portion and the leading edge portion.

8. The method of claim 7, wherein the trailing edge clamping arrangement includes at least two clamps spaced along a width of the trailing edge portion of the stacking region.

9. The method of claim 7, wherein the leading edge clamping arrangement includes at least two clamps spaced along a width of the leading edge portion of the stacking region.

10. The method of claim 9, wherein the leading edge clamping arrangement further includes corner clamps on ends of the width of the leading edge portion of the stacking region.

11. The method of claim 7, wherein the middle clamping arrangement includes a single clamp positioned substantially at a center of the stacking region.

12. A non-transitory computer-readable storage medium encoded with instructions executable by a processor of a computing system, the computer-readable storage medium comprising instructions to:

detect delivery of a print medium into a stacking region by an advancement mechanism;

actuate a trailing edge clamping arrangement in a trailing edge portion of the stacking region to secure a trailing edge of the print medium;

release the advancement mechanism with the trailing edge clamping arrangement actuated; and actuate a downstream clamping arrangement to secure a downstream portion of the print medium in the stacking region, the downstream clamping arrangement including a leading edge clamping arrangement in a leading edge portion of the stacking region and a middle clamping arrangement between the trailing edge portion and the leading edge portion.

* * * * *